United States Patent [19]

Lenards

[11] Patent Number: 5,008,130

[45] Date of Patent: Apr. 16, 1991

[54] METHOD OF PRODUCING A PATTERNED FLOCKED WEB OF MATERIAL

[75] Inventor: Gerhard F. Lenards, Mönchengladbach, Fed. Rep. of Germany

[73] Assignee: Uniroyal Textilcord, S.A., Steinfort

[21] Appl. No.: 369,775

[22] Filed: Jun. 22, 1989

[30] Foreign Application Priority Data

Jun. 22, 1988 [DE] Fed. Rep. of Germany ..... 3820992

[51] Int. Cl.[5] ..... B05D 5/00; B05D 1/16; B05D 1/36

[52] U.S. Cl. ..... 427/206; 427/26; 427/210

[58] Field of Search ..... 427/206, 26, 210; 428/90

[56] References Cited

U.S. PATENT DOCUMENTS 351,962 11/1886 Campbell ..... 427/206 X
3,533,892 10/1970 Kantorowicz ..... 427/206 X

FOREIGN PATENT DOCUMENTS 2708842 9/1978 Fed. Rep. of Germany .
3617163 11/1987 Fed. Rep. of Germany .
2071354 9/1971 France .

*Primary Examiner*—Evan Lawrence
*Attorney, Agent, or Firm*—Robert W. Becker & Associates

[57] ABSTRACT

A method of producing a patterned flocked web of material, where the textile carrier surface that is provided with a pattern is provided with a transparent adhesive layer into which are introduced light, single-color flock. This results in a flocked web of material that has a fine textile appearance with a muted decorative pattern that stands out in a softened manner from the background of the carrier surface, and has a pastel or water color appearance.

6 Claims, 1 Drawing Sheet

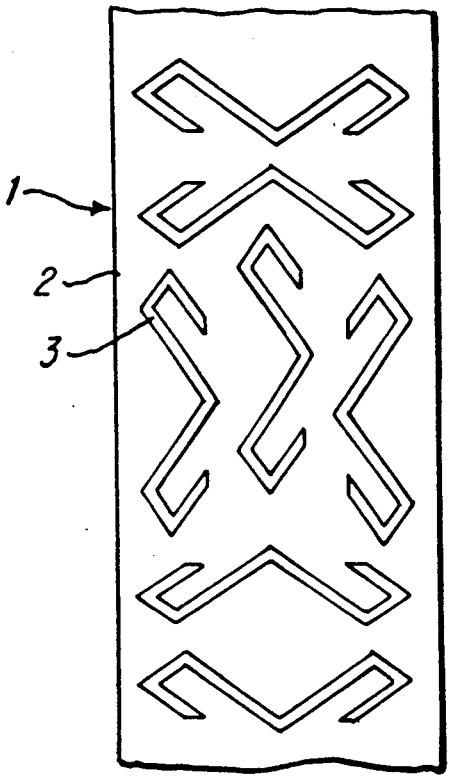
FIG-1
FIG-2
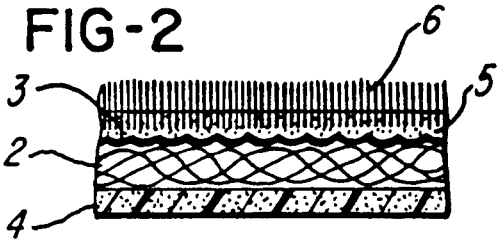
FIG-3
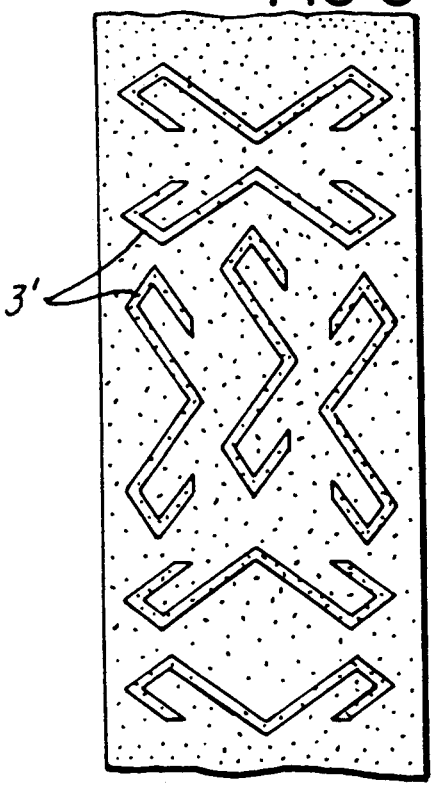
FIG-4
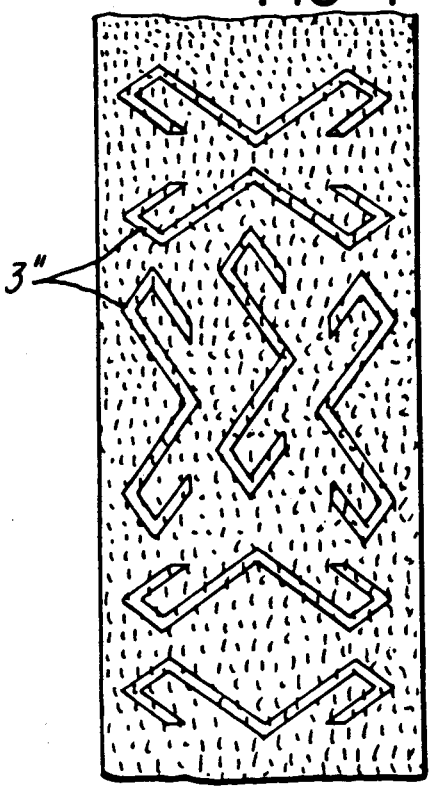

METHOD OF PRODUCING A PATTERNED FLOCKED WEB OF MATERIAL

BACKGROUND OF THE INVENTION

1. Field of the Invention

The present invention relates to a method of producing a patterned flocked sheet or web of material, and includes the step of applying an adhesive layer to a patterned carrier sheet or web. A pattern can be printed on with dye pursuant to known printing processes, such as low pressure or rotary screen printing processes. The carrier web is then covered with flock, preferably electrostatically, is thereupon dried and fixed, and excess flock is then removed therefrom.

2. Description of the Prior Art

German Offenlegungsschrift 27 08 842 to Hirdina dated Sept. 7, 1978 discloses color printing a carrier web and then covering the same with flock. In this connection, an adhesive layer is applied to a carrier web of sheet metal, plastic, cardboard, or the like via a screen printing machine. The carrier web is then preferably electrostatically covered with flock, and is subsequently dried. Thereupon, a desired layer of color is applied to the flock layer via a screen printing or offset printing machine. At this point, the printed carrier web has the contour and shade of the desired pattern; depending upon the pattern, the carrier web is provided with plain or dyed flock. In this manner, the web of material receives a velvet-like surface with a clearly recognizable, high-color contrast. After application of the printing dye in the desired shade and pattern on the flock layer, a dyed and patterned flock surface is provided.

German Offenlegungsschrift 36 17 163 to Marawesik dated Nov. 26, 1987 discloses using, as a carrier web, a pigmented plastic foil and/or a plastic foil that is printed with one or more colors, preferably pursuant to a low-pressure process, with such plastic foils having a specific thickness and hardness, or fleece or non-woven fabric of synthetic material that has a certain surface density and is printed with one or more colors, preferably in a rotarY screen printing process.

The carrier web is partially coated with an adhesive pursuant to the known low-pressure process. This can be effected with the aid of screens. Only those locations of the carrier web where adhesive is present are subsequently covered with flock. After the drying process and the removal of excess flock, a patterned flocked web of material is provided that has a fine surface that represents details of the pattern without requiring embossment for this purpose. The textile-like surface has a clearly recognizable pattern of high contrast. A plastic foil that is lined with a woven fabric can also be used as a carrier web.

In contrast, it is an object of the present invention to provide a patterned flocked web of material where the pattern does not have a distinct high contrast, but is rather recognizable as being of a muted shade and pastel or water color appearance.

It is a further object of the present invention to provide a patterned flocked web of material where either a patterned or printed carrier web is covered with flock, with the contour of the pattern standing out from the patterned background of the carrier web in a muted and softened manner, i.e. without having a high contrast.

BRIEF DESCRIPTION OF THE DRAWING

These and other objects and advantages of the present invention will appear more clearly from the specification in conjunction with the accompanying schematic drawing, in which:

FIG. 1 is a plan view of a patterned carrier web of one exemplary embodiment of an inventive patterned web of material;

FIG. 2 is a cross-sectional view of the web of material of FIG. 4;

FIG. 3 shows the same view as in FIG. 1, but with the pattern differing due to the presence of adhesive; and FIG. 4 is a view similar to that of FIG. 1 after flocking has been completed.

SUMMARY OF THE INVENTION

The method of the present invention is characterized primarily in that a transparent adhesive layer is applied to the patterned surface of a textile web that forms the carrier web in such a way as to cover this surface, whereupon the adhesive layer is covered with light, uni-color, single-color flock. The flocked web of material can also be printed with a multi-color pattern on the carrier web. The patterned or printed substrate can be present in the form of woven, knit, or raschel material, or even as non-woven or fleece material, or furthermore as textured fabric, with this substrate being covered with a transparent adhesive layer and subsequently being electrostatically covered with light, single-color flock, preferably of uniform length.

After the flocked substrate web has been dried and fixed, the patterned flocked web of material that is obtained has a fine textile appearance with a muted decorative pattern that stands out from the background of the patterned surface of the web of material via the adhesive and flock layer. When light shines thereon, the patterned contours have a muted and pastel appearance due to the light, single-color flock. Depending upon the direction in which the flocked web of material is viewed, the pattern appears to stand out from the background larger than it actually is.

The printed textile material can furthermore be lined with a foam layer in conformity with the later application. The lined web of material of the patterned flocked carrier web preferably has a foam thickness in a range of 1 to 10 mm.

The patterned flocked web of material of the present invention can be used to great advantage in the automotive industry. The web of material can be used for the ceiling of the vehicle, the back seat ledge or rear window deck, the door covering, the column covering, the trunk lining, for dashboard linings, as well as for carpeting. The inventive patterned flocked web of material can furthermore be advantageously used for home and office textiles and fabrics. In this connection, the web of material can be used as upholstery, wall coverings, curtains, and carpeting.

Further features of the present invention will be described in detail subsequently.

DESCRIPTION OF PREFERRED EMBODIMENTS

Referring now to the drawings in detail, FIG. 4 shows one exemplary embodiment of the inventive patterned textile or fabric sheet or web 1. A cross-sectional view of this web of material is shown in FIG. 2, with the reference numeral 2 indicating a woven material, the reference numeral 3 indicating a pattern, and the reference numeral 4 indicating a lined foam layer.

The woven material 2, as a carrier web with the pattern 3, is shown in FIG. 1. This carrier web is provided with a transparent adhesive in such a way as to cover the same: the adhesive layer is indicated by the reference numeral 5. A light or pastel, single-color flock is subsequently introduced into the adhesive laYer 5 to cover the same: the laYer of flock is indicated by the reference numeral 6.

FIG. 3 is a view similar to FIG. 1, but with the pattern 3' already having a different contour due to the adhesive covering. FIG. 4 then shows the same view as FIGS. 1 and 3, but after flocking. The pattern 3" now stands out from the background in a muted, softened, and pastel manner. Depending upon how the light strikes it, the pattern can appear larger than its actual size. In place of the patterned or pattern-printed textile material, it is also possible to use a textured fabric as the carrier web. The inventively patterned flocked web of material has a fine textile surface with a softened pattern. The inventive web of material is excellently suited for the aforementioned applications, and represents a further enrichment of the decorative means.

The present invention is, of course, in no way restricted to the specific disclosure of the specification and drawing, but also encompasses any modifications within the scope of the appended claims.

What I claim is:

1. In a method of producing a patterned flocked web of material, the improvement therewith comprising the steps of:

first providing a patterned carrier web in the form of a textile web that has a patterned surface;

secondly applying a transparent adhesive layer to said patterned surface in such a way as to cover the same although allowing the patterned surface to appear through the transparent adhesive layer;

then covering said transparent adhesive layer with light, single-color flock to a predetermined extent;

thereupon drying and fixing the resulting arrangement; and finally removing excess flock so that the pattern of the web stands out from the background in a muted and softened manner.

2. A method according to claim 1, in which said adhesive layer is electrostatically covered with said flock.

3. A method according to claim 1, which includes the step of providing a textile carrier web having a surface that is printed with a pattern having at least one color.

4. A method according to claim 3, which includes the step of printing said patterned textile web surface via a low-pressure process.

5. A method according to claim 1, which includes the step of providing, as said textile carrier web, a textured fabric having a patterned surface.

6. A method according to claim 1, which includes the further step of lining said textile carrier web with a foam layer after said flocking process.

* * * * *

UNITED STATES PATENT AND TRADEMARK OFFICE

CERTIFICATE OF CORRECTION

PATENT NO. : 5,008,130

DATED : 16 April 1991

INVENTOR(S) : Gerhard F. Lenards

It is certified that error appears in the above-identified patent and that said Letters Patent is hereby corrected as shown below: Title page:

Item [73] Assignee: Uniroyal Englebert Textilcord S.A., Steinfort, Luxembourg.

Signed and Sealed this

Twelfth Day of January, 1993

*Attest:*

*Attesting Officer*

DOUGLAS B. COMER

*Acting Commissioner of Patents and Trademarks*